US006519128B1

(12) United States Patent
Nakamura et al.

(10) Patent No.: US 6,519,128 B1
(45) Date of Patent: Feb. 11, 2003

(54) GAS-TYPE POWER BREAKER

(75) Inventors: Goro Nakamura, Shizuoka-ken (JP); Takahiro Sato, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 152 days.

(21) Appl. No.: 09/639,638

(22) Filed: Aug. 16, 2000

(30) Foreign Application Priority Data

Aug. 23, 1999 (JP) ..... 11-236118

(51) Int. Cl.[7] ..... H01H 73/00; H01H 85/00

(52) U.S. Cl. ..... 361/115; 200/61.08

(58) Field of Search ..... 200/61.39, 61.47, 200/61.8, 82 D; 337/30, 401; 307/10.7, 10.1; 318/139; 439/258, 52; 361/115, 120

(56) References Cited

U.S. PATENT DOCUMENTS 4,581,504 A * 4/1986 Hamel, Sr. ..... 200/61.08
5,535,842 A 7/1996 Richter et al. ..... 180/279
5,621,197 A * 4/1997 Bender et al. ..... 200/61.08
5,808,253 A * 9/1998 Hatakeyama ..... 200/61.08
6,078,108 A * 6/2000 Froschl ..... 307/10.7
6,144,111 A * 11/2000 Krappel et al. ..... 307/10.1
6,232,568 B1 * 5/2001 Hasegawa et al. ..... 200/61.08

FOREIGN PATENT DOCUMENTS

| | | |
|---|---|---|
| DE | 4422177 | 1/1996 |
| DE | 29613221 | 11/1996 |
| JP | 11-301376 | 11/1999 |

OTHER PUBLICATIONS

European Search Report for EP 00 11 7342, Jul. 29, 2002.

* cited by examiner

*Primary Examiner*—Gregory J. Toatley, Jr.
*Assistant Examiner*—Pia Tibbits
(74) *Attorney, Agent, or Firm*—Finnegan, Henderson, Farabow, Garrett & Dunner, L.L.P.

(57) ABSTRACT

A reset knob 20 is mounted to a tip end of a shaft. A front cover 24 having a resilient locking arm 23 is mounted to the reset knob 20. The base body 15 is formed with an engaging projection 25. The resilient locking arm 23 and the engaging projection 25 are engaged with each other at an initial position of the shaft, thereby forming an engaging portion B between the base body 15 and the front cover 24. Therefore, it is possible to prevent the shaft from sliding by factor such as impact and vibration other than sublimation of the gas-starting agent, and to prevent the power circuit from being interrupted.

3 Claims, 5 Drawing Sheets

GAS-TYPE POWER BREAKER

BACKGROUND OF THE INVENTION

The present invention relates to a gas-type power breaker for interrupting a power circuit utilizing sublimation of a gas starting agent for example, and more particularly, to a gas-type power breaker which can easily be assembled and which can forcibly and reliably interrupt a power circuit when abnormal conditions were encountered or a short circuit, collision of vehicle or the like occurred.

Japanese Patent Application Laid-open No. H11-301376 discloses a structure in which in a gas-type power breaker which can forcibly interrupt a power circuit utilizing sublimation of a gas starting agent when abnormal conditions were encountered or a short circuit, collision with a vehicle or the like occurred. However, a structure of the above-described conventional gas-type power breaker has the following problem. That is, since the shaft is held only by contacting load of the terminals, there is an adverse possibility that the shaft may malfunction due to an impact or vibration other than sublimation of the gas-starting agent.

Further, since the gas pressure is not released until the shaft moves to the interruption position, it is necessary to insert the nozzle into the shaft deeply, and there is a problem that it is difficult to assemble this kind of gas-type power breaker.

SUMMARY OF THE INVENTION

In view of the above circumstances, it is an object of the present invention to provide a gas-type power breaker which can easily be assembled and which can forcibly and reliably interrupt a power circuit only when abnormal conditions were encountered or a short circuit, collision of vehicle or the like occurred.

To achieve the above object, according to a first aspect of the present invention, there is provided a gas-type power breaker comprising a pair of terminals inserted in a power circuit for connecting a battery of a vehicle and loads provided in various portions of the vehicle, a shaft slidably inserted in a base body holding the terminals and capable of connecting and separating the terminals with and from each other by a sliding movement of the shaft, and circuit interrupting means for sliding the shaft from an initial position where the terminals are connected to each other to an interruption position where the terminals are separated from each other when a circuit interruption signal is input, thereby interrupting the power circuit, wherein a front cover having a resilient locking arm is mounted to one end of the shaft, the base body is formed with an engaging projection, and the resilient locking arm and the engaging projection are engaged with each other at the initial position of the shaft, and mounted in the vehicle.

According to the first aspect, the resilient locking arm of the front cover and the engaging projection of the base body are engaged with each other at the initial position of the shaft inserted in the base body, it is possible to prevent the shaft from sliding by factor such as impact and vibration other than sublimation of the gas-starting agent.

Accordingly, since the generated gas is compressed in the base body, and the shaft is slid and moved by the pressure generated by the compressed gas, it is unnecessary to insert the nozzle into the shaft deeply unlike the conventional technique. Since the ignitor is press-fitted into the rear end of the shaft, a nozzle itself is unnecessary, and it is possible to easily assemble this kind of gas-type power breaker.

According to a second aspect of the present invention, a gas vent hole capable of discharging out gas generated by sublimation of a gas-starting agent is formed on the base body closer to one of the terminals mounted to the front cover.

With the second aspect, when the sliding movement of the shaft is started by the gas generated by the sublimation of the gas-starting agent, the generated gas can be discharged out from the gas vent hole concurrently. Therefore, it is possible to obtain an arc-extinguishing effect for restraining an arc from being generated between the terminals by the gas pressure.

According to a third aspect of the present invention, the front cover is assembled such that it can turn around the shaft, and is capable of selecting a mounting position and a separating position with respect to the shaft by turning operation of the front cover, the front cover can be secured to a reset knob mounted to a tip end of the shaft in the mounting position with respect to the shaft, and the front cover can be pulled out from the reset knob in the separating position.

With the third aspect, the front cover is mounted such that it can rotate around the shaft, and the mounting position and the separating position with respect to the shaft can be selected by turning the front cover. In the mounting position with respect to the shaft, the front cover can be secured to the reset knob of the shaft, and in the separating position, the front cover can be pulled out from the reset knob. Therefore, the power circuit can be opened manually irrespective of movement of the shaft. Further, the power circuit can be closed by returning the reset knob into the base body while pushing the stopper which jumped out from the reset knob into the reset knob.

DESCRIPTION OF PREFERRED EMBODIMENT

Figure 1:
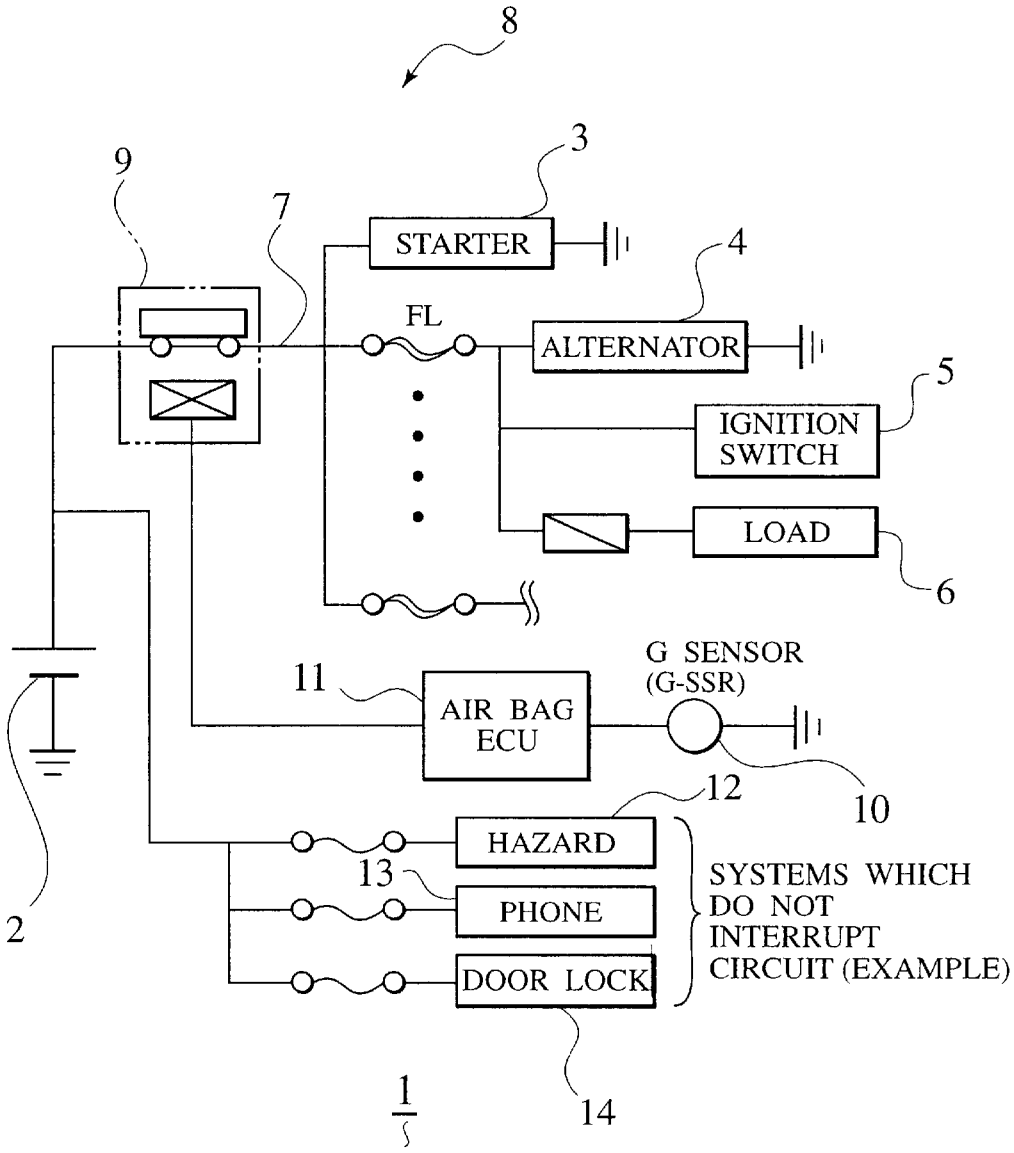
FIG. 1 is a block diagram showing one example of electrical equipment system to which a gas-type power breaker of the present invention is applied.

FIG. 1 is a block diagram showing one example of electrical equipment system to which a gas-type power breaker of the present invention is applied. As shown in FIG. 1, in this electrical equipment system 1, a starter 3, an alternator 4, an ignition switch (IGN.SW) 5, and other loads such as a load 6 provided in various portions of a vehicle are connected to a battery 2 of the vehicle through a wire harness 8 having an electric wire 7. A gas-type power breaker 9 of the present invention is interposed in the power circuit. A number 10 represents a G-sensor (GS-SSR), and a number 11 represents an air bag ECU. They are used for operating the gas-type power breaker 9. A number 12 represents a hazard, a number 13 represents a phone (PHONE), and a number 14 represents a door lock (D/L). They are. examples of system structural articles which do not interrupt the power circuit by the gas-type power breaker 9.

Figure 2:
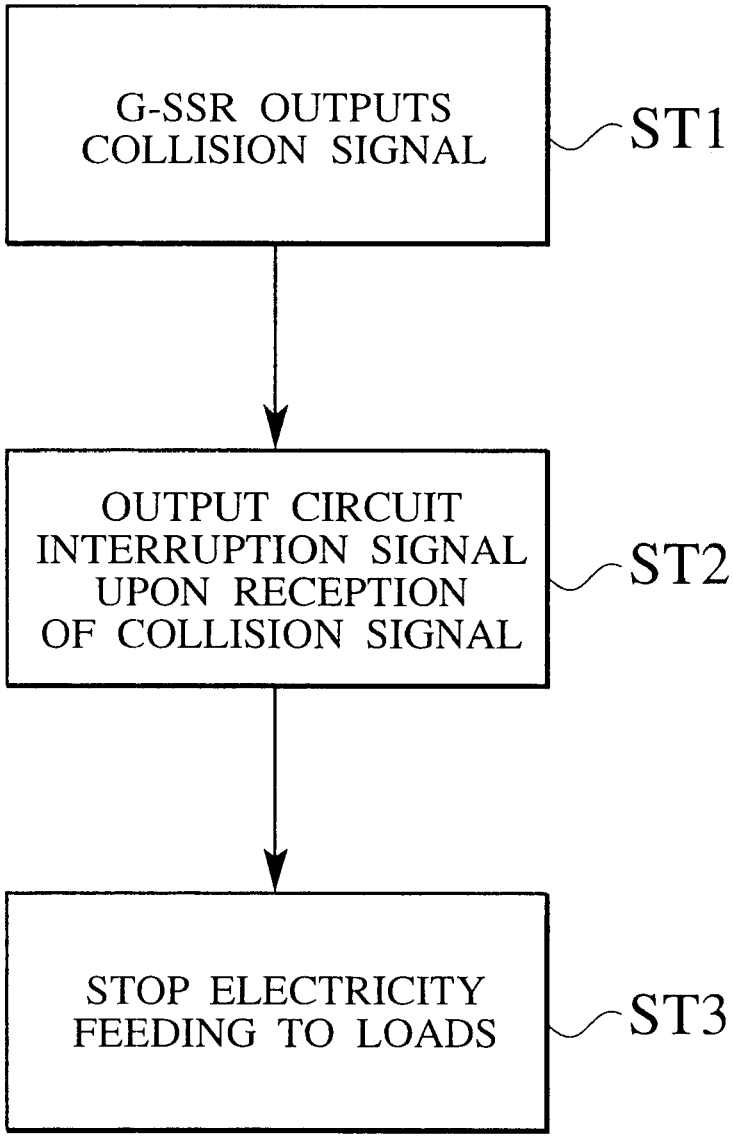
FIG. 2 is a flowchart showing an interrupting flow of the electrical equipment system shown in FIG. 1.

According to this electrical equipment system 1, as shown in the flow diagram of FIG. 2, if the subject vehicle collided against an object such as another vehicle ahead, and a collision signal was output from the G-sensor (G-SSR) 10 to the air bag ECU, (step ST2), a circuit interrupting signal is generated in the air bag ECU, and this generated circuit interrupting signal is output to the gas-type power breaker 9 (step ST2).

With this signal, the gas-type power breaker 9 can interrupt the power circuit to stop the electric supply from the battery 2 to the various loads, such as the starter 3, the alternator 4, the ignition switch (IGN.SW) 5 (step ST3) as will be explained below based on FIGS. 3 through 6.

Figure 3:
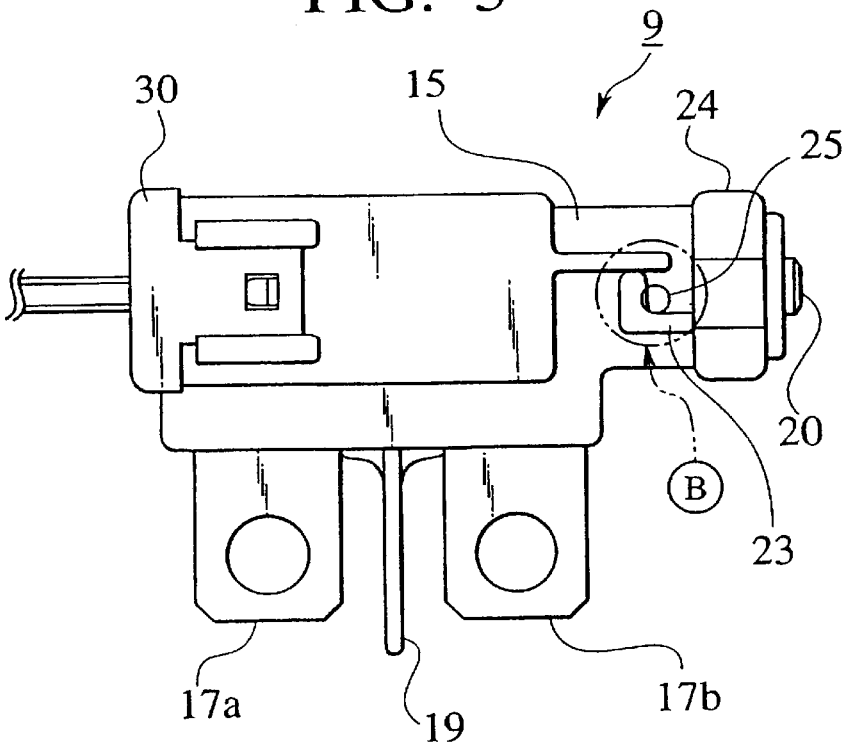
FIG. 3 is a side view of an embodiment of the gas-type power breaker in its initial state before it is operated.
Figure 4:
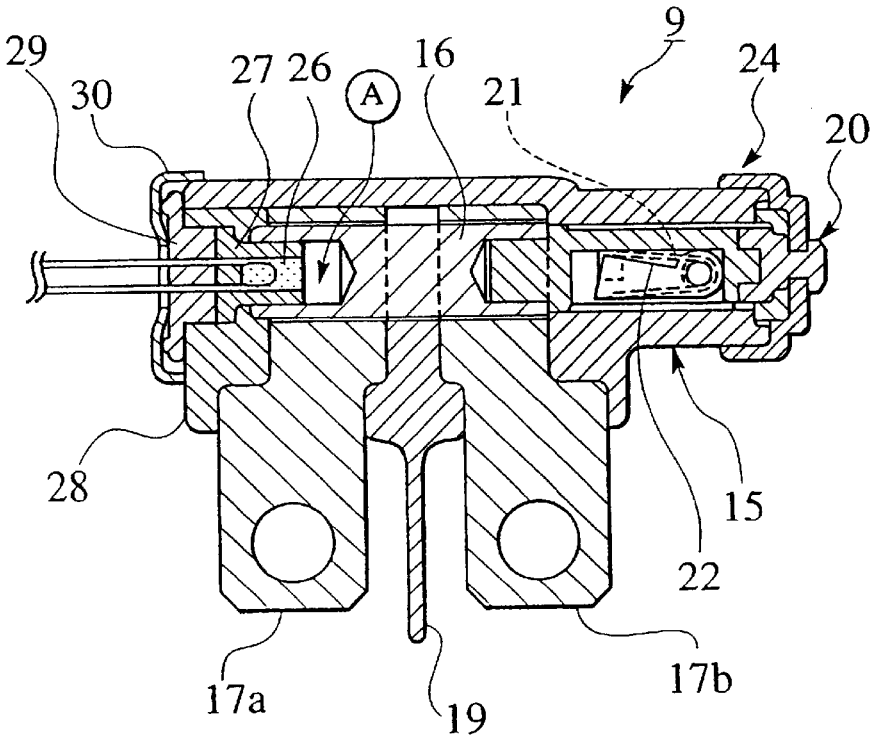
FIG. 4 is a sectional side view of an essential portion of the side view of FIG. 3.
Figure 5:
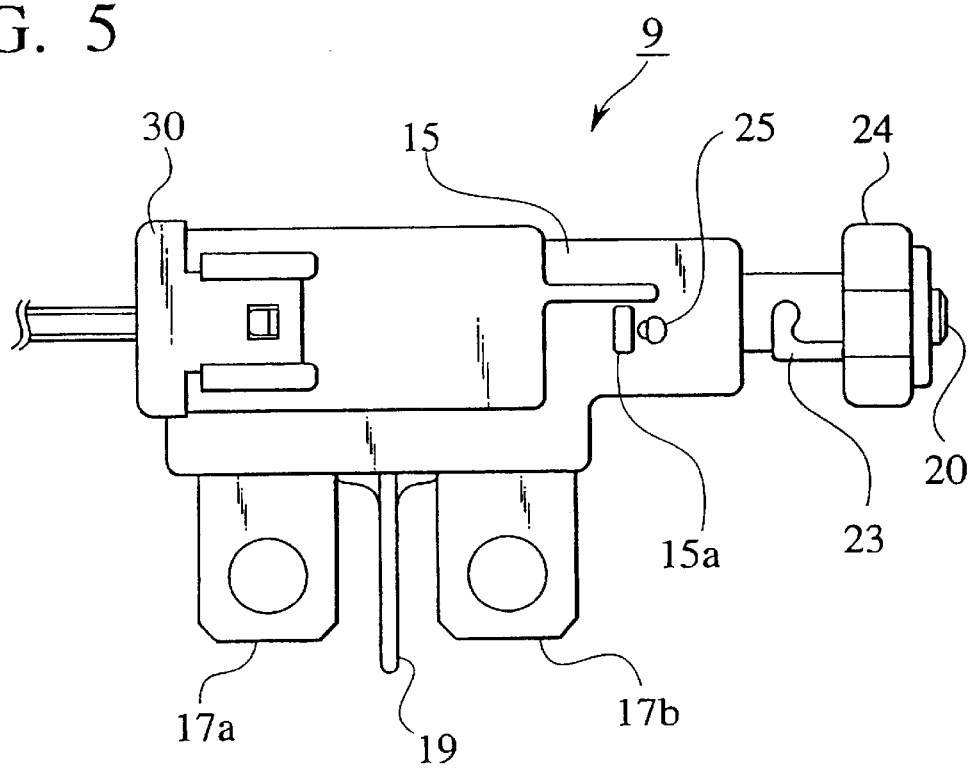
FIG. 5 is a sectional side view of an essential portion of the one example of the gas-type power breaker in its interruption state after it was operated.
Figure 6:
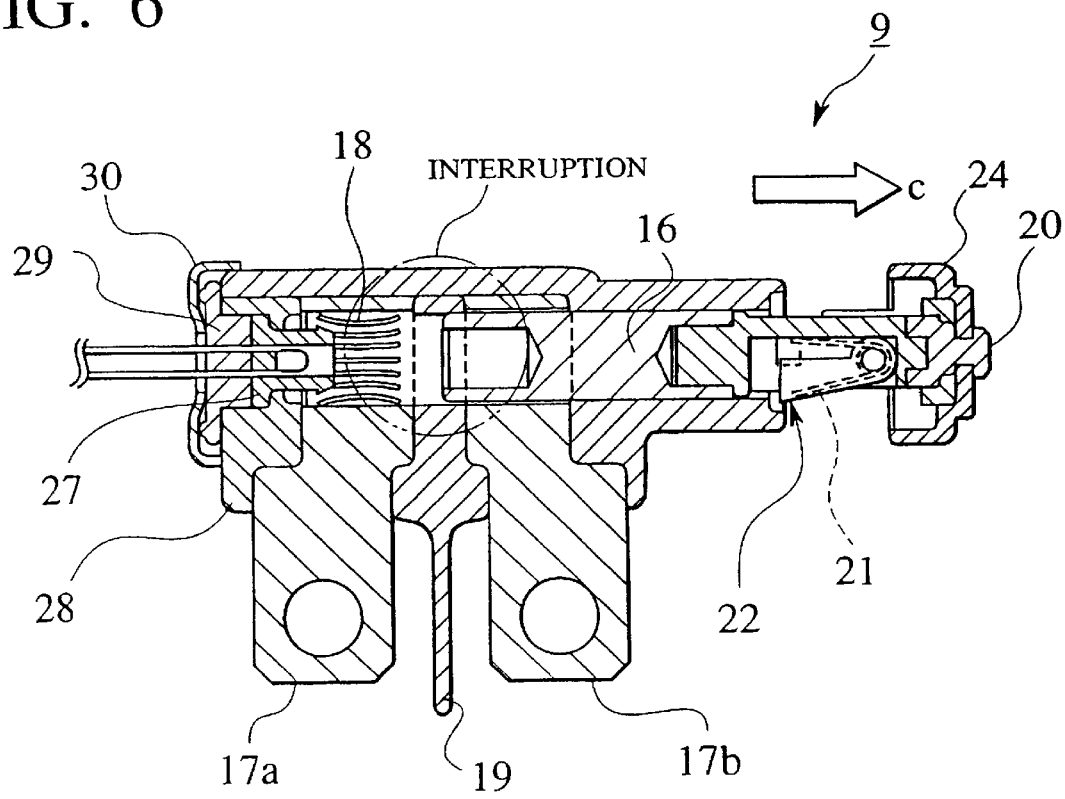
FIG. 6 is a sectional side view of an essential portion of a side surface shown in FIG. 5.

FIGS. 3 and 4 show a structure of one embodiment of the gas-type power breaker 9 of the present invention in its initial state before it is operated. FIG. 3 is a side view, and FIG. 4 is a sectional view of the side view of FIG. 3. FIGS. 5 and 6 shows the embodiment of the gas-type power breaker 9 in its interruption state after it was operated, wherein FIG. 5 is a sectional view and FIG. 6 is a sectional side view of the side view of FIG. 5.

As shown in FIGS. 4 and 6, in the gas-type power breaker 9, a shaft 16 is inserted in a base body 15, terminals 17*a,* 17*b* are connected to each other for feeding electricity from the battery 2 to each of the loads such as the starter 3 and the alternator 4.

In an initial state before the gas-type power breaker 9 is operated, the terminals 17*a,* 17*b* are electrically connected by a multi-point connection spring 18 provided on the shaft 16. Therefore, a current of the power circuit flows from terminal 17*a*→shaft 16→terminal 17*b*. As shown in FIG. 3, the terminals 17*a,* 17*b* are in contact with the multi-point connection spring 18 at contacts and thus, a large current can flow through the terminals 17*a,* 17*b*.

A reset knob 20 is mounted to a tip end of the shaft 16, and a torsion spring 21 and a stopper 22 are accommodated in the reset knob 20. In this mounting structure, at the time of the interrupting operation of the shaft 16, the stopper 22 jumps out from the reset knob 20 by a force of the torsion spring 21, thereby preventing the reset knob 20 from returning as will be described later.

As shown in FIG. 3, a front cover 24 is mounted, through a resilient locking arm 23, to the reset knob 20 mounted on the tip end of the shaft 16. The base body 15 is formed with an engaging projection 25. The resilient locking arm 23 and the engaging projection 25 are engaged with each other at the initial position of the shaft 16 to form an engaging portion B between the base body 15 and the front cover 24. As shown in FIG. 5, a gas vent hole 15*a* for discharging out gas generated by the sublimation of the gas-starting agent, is formed on in the base body 15 on which the front cover 24 is mounted in the vicinity of the terminal 17*b*.

An ignitor 27 in which the gas-starting agent 26 is accommodated, is mounted to a rear end of the shaft 16. The ignitor 27 is held by a holder 28. A rear cover 30 is engaged with the base body 15 through a rear packing 29.

In such an assembling structure, the shaft 16 is held by a holding force F which is the resultant of a separating force f1 of the terminals 17*a,* 17*b* and a holding force f2 of the front cover 24 and the base body 15. Therefore, when the gas is generated by the sublimation of the gas-starting agent 26, an internal pressure P in a portion A shown in FIG. 4 is increased. Here, a cross-sectional area in the portion A is defined as S. The generated gas is compressed until the following relation is established:

P(internal pressure of A)×S(cross-sectional area in A)>F(shaft holding force)

wherein F=f1+f2.

If the increasing ratio of the internal pressure P exceeds the holding force of the shaft, the resilient locking arm 23 is resiliently deformed and thus, the engaging portion B between the base body 15 and the front cover 24 is released.

With this operation, the gas-type power breaker 9 of the present invention moves to the interruption state shown in the side view of FIG. 5 and the sectional view of FIG. 6. That is, as shown in these drawings, the shaft 16 projects from the base body 15 in a direction of arrow C, thereby interrupting the power circuit. With this feature, the following effects (1) to (3) can be obtained.

(1) It is possible to prevent the shaft 16 from sliding by factor such as impact and vibration other than sublimation of the gas-starting agent 26, and to prevent the power circuit from being interrupted.

(2) At the time of interruption, gas is discharged out from the gas vent hole 15*a* through the terminals 17*a,* 17*b,* and it is possible to obtain an arc-extinguishing effect for restraining an arc from being generated between the terminals 17*a,* 17*b* by the gas pressure.

(3) Since the generated gas is compressed, and the shaft 16 is slid and moved by the pressure generated by the compressed gas as described above, it is unnecessary to insert the nozzle into the shaft deeply unlike the conventional technique. As in the gas-type power breaker 9 applied to this embodiment, the nozzle itself is unnecessary by press-fitting the ignitor 27 into the rear end of the shaft 16, it is possible to easily assemble this kind of gas-type power breaker.

In addition, in the gas-type power breaker 9 applied to the present embodiment, the front cover 24 is mounted such that it can rotate around the shaft 16, and the mounting position and the separating position with respect to the shaft 16 can be selected by turning the front cover 24. In the mounting position with respect to the shaft 16, the front cover 24 can be secured to the reset knob 20 of the shaft 16, and in the separating position, the front cover 24 can be pulled out from the reset knob 20.

Therefore, the power circuit can be opened manually irrespective of movement of the shaft 16 by the sublimation of the gas-starting agent 26. Further, the power circuit can be closed by returning the reset knob 20 into the base body 15 while pushing the stopper 22, which jumped out from the reset knob 20, back into the reset knob 20.

Figure 7A:
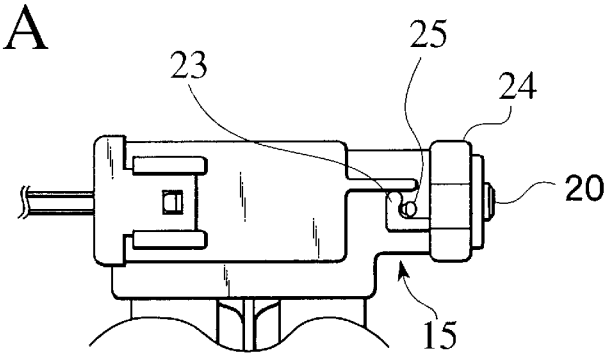
FIGS. 7A to 7D are views of transitional state showing a procedure for manually interrupting the gas-type power breaker of the invention.

FIGS. 7A to 7D are views of transitional state showing a procedure for manually interrupting the gas-type power breaker of the invention. In the gas-type power breaker 9 of the present invention, as shown in FIG. 7A, the resilient locking arm 23 of the front cover 24 and the engaging projection 25 of the base body 15 are engaged with each other at the initial position (see FIG. 4) of the shaft 16 and mounted to the vehicle. With this operation, it is possible to prevent the shaft 16 from sliding by factor such as impact and vibration other than sublimation of the gas-starting agent 26, and to prevent the power circuit from being interrupted as described above.

However; it may be required to interrupt the gas-type power breaker 9 manually in some cases for convenience of inspection of various parts mounted in the vehicle, for preventing the battery from being consumed by a dark current during long term storage of the vehicle, or for inspecting the power breaker 9 itself.

Figure 7B:
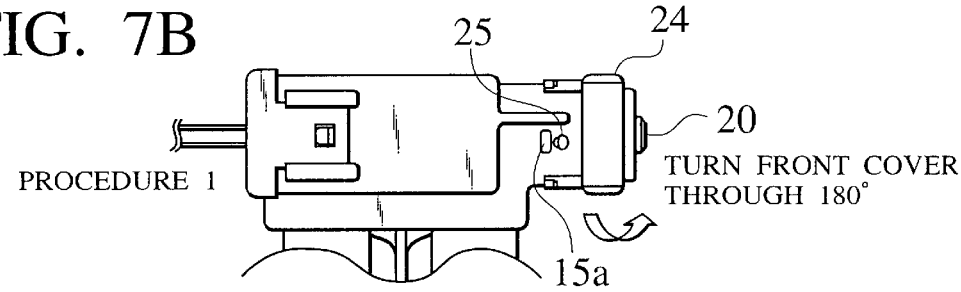

In such a case, according to a procedure (1) shown in FIG. 7B, the front cover 24 is turned from the mounting position through 90° to release the engagement between the resilient locking arm 23 and the engaging projection 25.

Figure 7C:
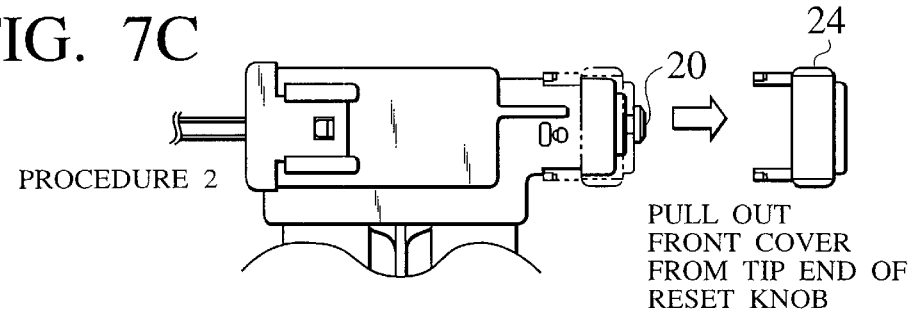

Next, according to a procedure (2) shown in FIG. 7C, the front cover 24 is pulled out from the tip end of the reset knob 20.

Figure 7D:
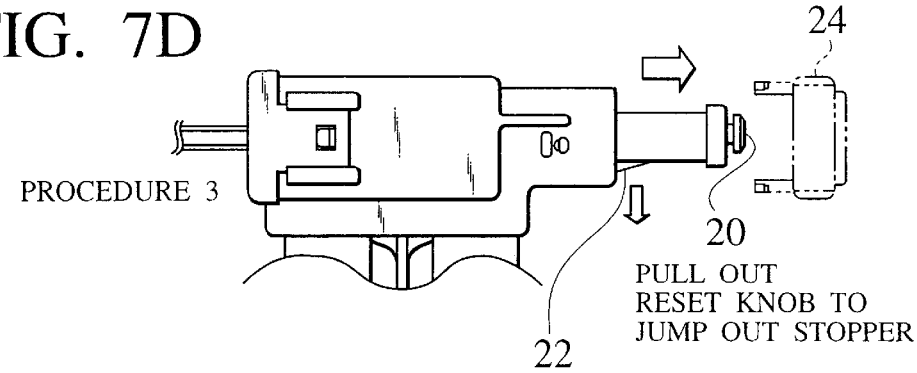

Then, according to a procedure (3) shown in FIG. 7D, the reset knob 20 is pulled out from the base body 15. By pulling out the reset knob 20, the stopper 22 jumps out from the reset knob 20. In a normal operation, in a state in which the stopper 22 jumps out from the reset knob 20, the shaft 16 provided at its tip end with the reset knob 20 does not return to the initial position, which assures safety.

In this manner, the front cover 24 can select the mounting position and the separating position by the turning operation. In the mounting position, the front cover 24 can be secured to the reset knob 20 of the shaft 16, and in the separating position, the front cover 24 can be pulled out from the reset knob 20. Therefore, as described above, the power circuit can be opened manually irrespective of movement of the shaft 16 by the sublimation of the gas-starting agent. Further, the power circuit can be closed by returning the reset knob 20 into the base body 15 while pushing the stopper 22 which jumped out from the reset knob 20 into the reset knob 20.

What is claimed is:

1. A gas-type power breaker comprising:

a pair of terminals inserted in a power circuit for connecting a battery of a vehicle and loads located in various portions of the vehicle;

a shaft slidably inserted in a base body holding said terminals, the shaft being capable of connecting and separating said terminals with and from each other by a sliding movement of said shaft;

circuit interrupting means for sliding said shaft from an initial position where said terminals are connected to each other, to an interruption position where said terminals are separated from each other when a circuit interruption signal is input, thereby interrupting said power circuit; and a front cover having a resilient locking arm, the front cover being mounted to one end of said shaft, wherein said base body is formed with an engaging projection, and said resilient locking arm and said engaging projection are engaged with each other at said initial position of said shaft, and said resilient locking arm and said engaging projection are mounted in the vehicle.

2. The gas-type power breaker of claim 1, further comprising a gas vent hole capable of discharging gas generated by sublimation of a gas-starting agent, the gas vent hole being formed on said base body adjacent to said terminals and said front cover.

3. The gas-type power breaker of claim 1 or 2, wherein said front cover is assembled such that it can turn around said shaft, said front cover being capable of selecting a mounting position and a separating position with respect to said shaft by turning operation of said front cover, said front cover being capable of being secured to a reset knob mounted to a tip end of said shaft in said mounting position with respect to said shaft, and said front cover being capable of being pulled out from said reset knob in said separating position.

* * * * *